United States Patent [19]

Gavel

[11] 4,146,113

[45] Mar. 27, 1979

[54] NOISE-PROTECTION SCREEN

[75] Inventor: Peter Gavel, Stockholm, Sweden

[73] Assignee: Gavels Arkitektkontor AB, Stockholm, Sweden

[21] Appl. No.: 834,135

[22] Filed: Sep. 16, 1977

Related U.S. Application Data

[63] Continuation of Ser. No. 607,500, Aug. 25, 1975, abandoned.

[51] Int. Cl.[2] ..... E04B 1/99; E01F 15/00

[52] U.S. Cl. ..... 181/210; 181/284; 256/13.1

[58] Field of Search ..... 181/210, 295, 284, 290; 256/13.1, 24, 73; 244/114 B

[56] References Cited

U.S. PATENT DOCUMENTS

| | | | |
|---|---|---|---|
| 3,667,175 | 6/1972 | Bjorksten | 181/284 |
| 3,846,949 | 11/1974 | Okawa | 181/285 |
| 3,934,382 | 1/1976 | Gartung | 181/287 |
| 3,936,035 | 2/1976 | Weimir et al. | 256/13.1 |
| 3,983,956 | 10/1976 | Manhart | 256/13.1 |

*Primary Examiner*—Stephen J. Tomsky

*Attorney, Agent, or Firm*—Burns, Doane, Swecker & Mathis

[57] ABSTRACT

The noise protection screen of the present invention comprises a plurality of hollow tubular members, preferably of equal length and substantially elliptical in cross-section. The hollow members are formed of a flexible material and inclined at an angle to the horizontal. The hollow members are interconnected by corresponding tongue-and-groove engagement whereby the engaged grooves are deformed in a manner to provide a clamping action of the grooves about the corresponding tongues.

7 Claims, 6 Drawing Figures

NOISE-PROTECTION SCREEN

This is a continuation, of application Ser. No. 607,500, filed Aug. 25, 1975, and now abandoned.

This invention relates to a noise-protection screen to shield residential areas or the like against traffic noise, for example from a motorway.

Most of the conventional noise-protection screens are heavy and relatively complicated structures with poor adaptability to varying profiles of the ground and requiring extensive foundation work.

The present invention has the object to provide a noise-protection screen of simple construction, adaptable to variations in the ground profile and having a simple foundation. The screen is also intended for use where subsidences can be expected to take place, for example at the top of an earth bank.

This object is achieved by a noise-protection screen, which is assembled of a plurality of hollow tubular members of preferably equal length mounted inclined in relation to the horizontal plane.

Figure 1:
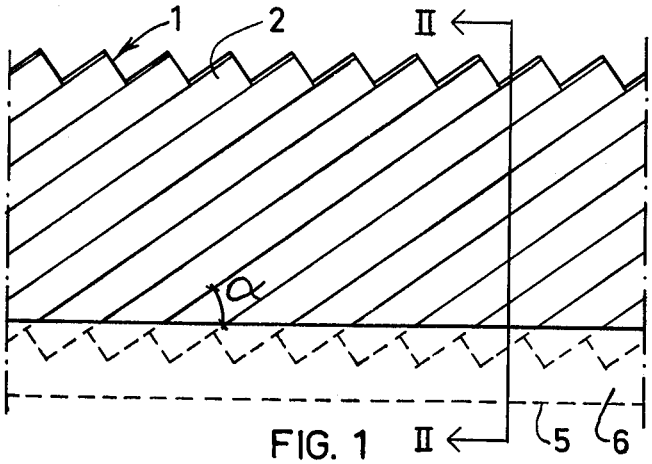
Figure 2:
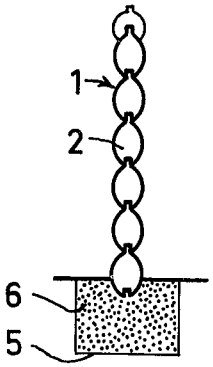
Figure 3:
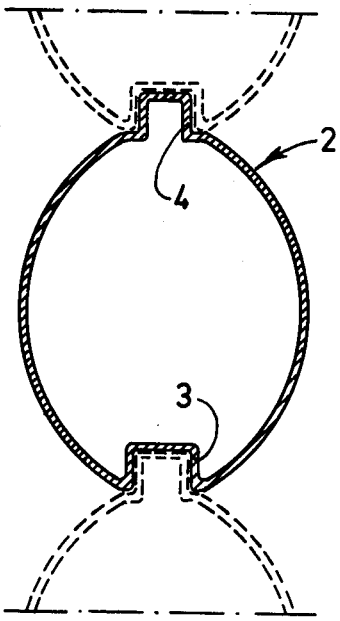
Figure 4:
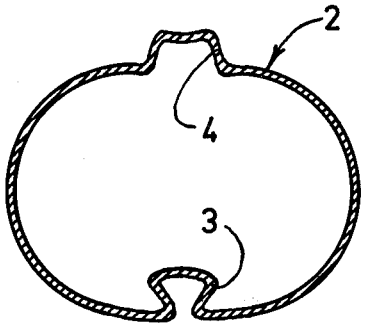
Figure 5:
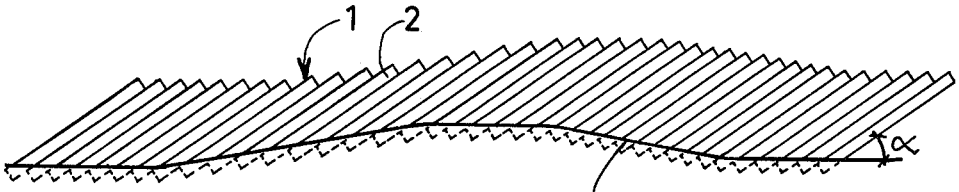
Figure 6:
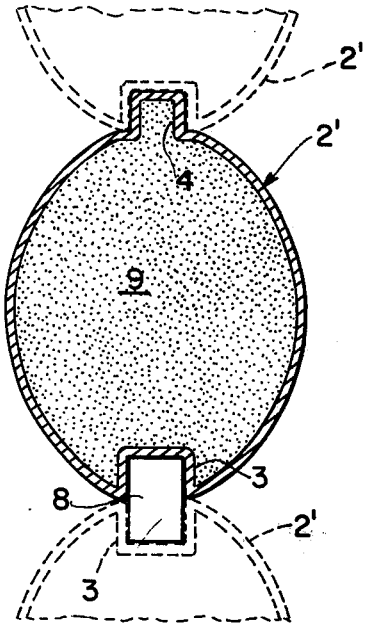

One embodiment of the invention is described in the following, with reference to the accompanying drawings, in which FIG. 1 is a front view of a noise-protection screen according to the invention, FIG. 2 is a section after the line II—II in FIG. 1, FIG. 3 is a cross-section through a single member where the jointing by groove-and-tongue with members located above and below said member is indicated by dashed lines, FIG. 4 shows a deformed member, and FIG. 5 shows the noise-protection screen at varying ground profile, FIG. 6 is a view similar to that in FIG. 3 but showing tubular members joined by groove and loose tongue.

In FIG. 1 a noise-protection screen 1 is shown which comprises a plurality of oblong hollow tubular members 2, preferably of plastics. The members are inclined at an angle $\alpha$ to the horizontal plane and arranged above each other, said angle $\alpha$ being in the range 0°–90°. By varying the angle $\alpha$, i.e. the inclination of the members to the ground-level, it is possible to vary the height of the screen at the same length of the members, which is an advantage from the manufacturing and storing point of view. A member length of 4 m, for example, and the angle $\alpha$18 25° render a height of 1,5 m while the angle $\alpha \sim 45$ brings about a screen height of 2,5 m. The members 2 are jointed to each other by a groove 3 and a fixed tongue 4 (see FIG. 3). They may have different cross-sectional shape, but the somewhat "flattened" tubular section shown in FIG. 3 seems to be suitable. The cross-section of the members 2, however, may be of circular, square or rectangular shape.

FIG. 3 shows a member 2 in unloaded state. As the members are stacked one upon the other, a member 2 will be deformed by the weight of the member lying thereabove. FIG. 4 shows the member 2 in deformed state. As can be seen, the groove 3 tends to be forced together while the tongue 4 tends to expand.

A joint between two members 2, thus, comprises a groove 3 and a tongue 4 where the groove 3 is forced together and the tongue 4 is expanded. The members are hereby interlocked by action of their own weight. The resulting joints are consequently extremely tight, which is necessary from the acoustic aspect. It is also possible, of course, to use other types of joints providing a tight wall surface, for example groove and loose tongue as illustrated in FIG. 6. In this latter type of joint the hollow tubular members 2' are provided with opposite grooves 3, 3 and adjacent members are joined together in the screen by a loose tongue 8 which functions similarly to fixed tongue 4.

When for static reasons the dead weight of the members 2 is to be increased, the members 2 can be filled with a suitable material 9, for example sand as illustrated in FIG. 6. In some cases it may be desirable to increase the sound reduction factor or the sound absorption capacity. In such cases the members 2 can be filled with a suitable material, for example foam plastic or mineral wool. At sound absorption also the screen surface facing toward the noise source can be perforated.

The members, of course, may also be filled with a combination of materials increasing the dead weight of the members, the sound reduction factor and the sound absorption.

The foundation of the noise-protection screen 1 can be carried out so that a shallow trench 5 is digged, into which the members are positioned inclined, and which then is refilled with gravel 6, macadam or the like. Furthermore, at a suitable c/c distance supports (not shown) are arranged to take up wind loads and in horizontal curves to "guide" the screen. It may happen at times that the filler material 6 is removed by erosion or in some other way, so that an intermediate space is formed between the ground surface and the screen, thereby deteriorating the noise-protection capacity of the screen 1. When the members 2 then are filled with, for example, sand, the sand will flow out at the lower end of the member 2 and fill the space between the ground surface and noise-protection screen.

Due to the fact that the members are jointed together inclined and can be moved longitudinally relative to each other, the screen has good adaptability to varying ground profile. This is demonstrated in FIG. 5 by a member inclination of $\alpha \sim 35°$. It is to be mentioned that FIG. 5 shows a ground profile 7 with substantial inclinations, i.e. a situation which many other screen types have difficulties to cope with, because they usually are designed with members or bearing structures lying horizontally.

The embodiment of the member 2 shown in FIG. 3 with a somewhat flattened circular section renders the member 2 ductile about the vertical axis whereby the screen becomes adaptable in transverse direction. This is necessary in order to enable the screen to adapt to occurring road radii. One prerequisite of the ductility of the members 2, however, is their manufacture of a suitable material, preferably plastics.

The members 2 may also be made of a material other than plastics, for example of sheet metal, fibrous cement, wood or wood fibre. The section of the members is in such cases to be so adjusted that sufficient ductility is obtained. The screen 1 being elastic, it will also resist resiliently to impacts. When also the supports (not shown) of the screen 1 are designed so as to be resiliently resistant to impacts, no collision-proof guard rail is required which is necessary at many other screen types for protecting the motorists against collision with the screen.

The invention is not restricted to the embodiment described above, but can freely be varied within the scope of the following claims.

What I claim is:

1. A noise protection screen comprised of a plurality of hollow tubular members of equal length and substantially ellipitical in cross-section, each of said hollow members being formed of flexible material and being arranged in a vertical plane and inclined at an angle of from 15 to 75 degrees to the horizontal, said hollow members being interconnected by corresponding tongue-and-groove engagement and interlocked by action of the weight of the hollow members upon each other whereby the engaged grooves are deformed in a manner to provide a clamping action of the grooves about the corresponding tongues, each hollow member having a fixed projecting tongue extending longitudinally on one side and a recessed groove extending longitudinally within an opposing side, the tongue-and-groove engagement occurring between a fixed tongue of one hollow member and a corresponding groove within an adjacent hollow member.

2. The noise protection screen of claim 1 wherein the hollow members are comprised of a plastic material.

3. The noise protection screen of claim 1 wherein the hollow members are filled with sand.

4. The noise protection screen of claim 1 wherein the hollow members are filled with sound absorbing material.

5. The noise protection screen of claim 4 wherein said sound absorbing material comprises foamed plastic.

6. The noise protection screen of claim 4 wherein said sound absorbing material comprises mineral wool.

7. A noise protection screen comprised of a plurality of hollow tubular members of equal length and substantially elliptical in cross-section, each of said hollow members being formed of flexible materials and being arranged in a vertical plane and inclined at an angle of from 15 to 75 degrees to the horizontal, the hollow members being interconnected by corresponding tongue-and-groove engagement and interlocked by action of the weight of the hollow members upon each other whereby the engaged grooves are deformed in a manner to provide a clamping action of the grooves about the corresponding tongues, each hollow member having a fixed projecting tongue extending longitudinally on one side and a recessed groove extending longitudinally within an opposing side, the tongue-and-groove engagement occurring between adjacent grooves of adjacent hollow members and a loose tongue which engages said adjacent grooves, together with engagement between a fixed tongue of at least one of said adjacent hollow members and a corresponding groove in an additionally adjacent hollow member.

* * * * *

UNITED STATES PATENT AND TRADEMARK OFFICE

CERTIFICATE OF CORRECTION

PATENT NO. : 4,146,113

DATED : March 27, 1979

INVENTOR(S) : Peter GAVEL

It is certified that error appears in the above-identified patent and that said Letters Patent are hereby corrected as shown below:

In the Title Page, after "Related U.S. Application Data
[63] Continuation of Ser. No. 607,500, Aug. 25, 1975, abandoned." insert as a new paragraph the following:

--[30] Foreign Application Priority Data

Aug. 27, 1974 Sweden ..... 7410835 --.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*